US011059008B2

(12) United States Patent
Alexander et al.

(10) Patent No.: US 11,059,008 B2
(45) Date of Patent: Jul. 13, 2021

(54) REVOLVING CHAMBER OSCILLATION MIXING DEVICES AND ASSOCIATED METHODS

(71) Applicants: Richard W. Alexander, Lebanon, OR (US); Karl William Yost, Anacortes, WA (US)

(72) Inventors: Richard W. Alexander, Lebanon, OR (US); Karl William Yost, Anacortes, WA (US)

( * ) Notice: Subject to any disclaimer, the term of this patent is extended or adjusted under 35 U.S.C. 154(b) by 277 days.

(21) Appl. No.: 16/167,347

(22) Filed: Oct. 22, 2018

(65) Prior Publication Data

US 2019/0118149 A1 Apr. 25, 2019

Related U.S. Application Data

(60) Provisional application No. 62/575,244, filed on Oct. 20, 2017.

(51) Int. Cl.
*B01F 9/00* (2006.01)
*B01F 3/12* (2006.01)
(Continued)

(52) U.S. Cl.
CPC ..... *B01F 9/001* (2013.01); *B01F 3/12* (2013.01); *B01F 3/1271* (2013.01); *B01F 9/004* (2013.01);
(Continued)

(58) Field of Classification Search
CPC ..... B01F 9/001; B01F 3/12; B01F 13/1022; B01F 9/004; B01F 3/1271; B01F 9/0005;
(Continued)

(56) References Cited

U.S. PATENT DOCUMENTS 691,802 A * 1/1902 Patton ..... B01F 9/0005 366/235
2,018,082 A * 10/1935 Muench ..... B01F 9/0032 366/147
(Continued)

FOREIGN PATENT DOCUMENTS

JP 2011045873 A 3/2011
JP 2014065010 A 4/2014
(Continued)

OTHER PUBLICATIONS

International Search Report and Written Opinion for International Application No. PCT/U2018/056938; dated Apr. 3, 2019; 14 pages.

*Primary Examiner* — Charles Cooley
(74) *Attorney, Agent, or Firm* — Perkins Coie LLP

(57) ABSTRACT

Mixing devices and associated methods are described herein. Various embodiments of mixing devices can comprise a plate configured to rotate about a longitudinal axis and a plurality of enclosures coupled to the plate. The enclosures can each include (a) at least one sidewall that defines an oblique angle with the plate and (b) a chamber configured to receive a media and a fluid. The enclosures can be fluidly coupled to a fluid source for receiving the fluid in the chambers. When the plate is rotated, the enclosures revolve about the longitudinal axis to mix the media with the fluid in the chambers.

21 Claims, 10 Drawing Sheets

(51) Int. Cl.
*B01F 9/02* (2006.01)
*B01F 13/10* (2006.01)
*B01F 15/00* (2006.01)

(52) U.S. Cl.
CPC ..... *B01F 9/0005* (2013.01); *B01F 9/0032* (2013.01); *B01F 9/02* (2013.01); *B01F 13/1002* (2013.01); *B01F 13/1022* (2013.01); *B01F 15/00441* (2013.01); *B01F 15/00538* (2013.01); *B01F 15/00779* (2013.01); *B01F 15/00831* (2013.01); *B01F 2015/00077* (2013.01); *B01F 2015/00577* (2013.01); *B01F 2015/00623* (2013.01)

(58) Field of Classification Search
CPC ..... B01F 9/0032; B01F 9/02; B01F 13/1002; B01F 15/00538; B01F 15/00779; B01F 15/00831; B01F 15/00441; B01F 2015/00623; B01F 2015/00077; B01F 2015/00577; B01F 9/06
USPC ..... 366/225, 228, 229
See application file for complete search history.

(56) References Cited

U.S. PATENT DOCUMENTS 2,514,126 A * 7/1950 Fischer ..... B01F 9/0005 366/220
2,628,080 A * 2/1953 Mack ..... B01F 9/0036 366/139
2,689,713 A * 9/1954 Staller ..... B29B 7/106 366/77
2,841,370 A * 7/1958 Cosmetto ..... B01F 9/0054 366/232
2,901,227 A * 8/1959 Russum ..... B01F 9/04 366/235
3,134,578 A * 5/1964 Anderson ..... B01F 9/0005 366/235
3,381,944 A * 5/1968 Clary ..... B01F 9/0007 366/220
3,388,893 A * 6/1968 Hall ..... B01F 9/0007 366/135
3,552,724 A * 1/1971 Thomsen ..... B01F 9/0052 366/235
3,992,148 A * 11/1976 Shore ..... A23L 3/165 426/521
5,971,602 A * 10/1999 Dorn ..... B01F 9/0005 366/221
6,910,801 B2 * 6/2005 Sasaki ..... B01F 9/0001 366/220
2002/0145938 A1 10/2002 Sasaki
2019/0118149 A1 * 4/2019 Alexander ..... B01F 15/00441

FOREIGN PATENT DOCUMENTS

JP 2016016390 A 2/2016
SU 1243797 A1 * 7/1986 ..... B01F 9/04
SU 1368015 A1 * 1/1988 ..... B01F 9/0036
WO 2012172664 A1 12/2012

* cited by examiner

REVOLVING CHAMBER OSCILLATION MIXING DEVICES AND ASSOCIATED METHODS

CROSS-REFERENCE TO RELATED APPLICATION

This application claims priority to U.S. Provisional Patent Application No. 62/575,244, titled "A TUMBLER TO PROVIDE MULTIDIRECTIONAL AND TRI-AXIAL INTERACTION BETWEEN FLUID AND SOLID MEDIA," filed Oct. 20, 2017, which is incorporated herein by reference in its entirety.

TECHNICAL FIELD

The present technology generally relates to devices and methods for mixing fluids with other media, and more particularly relates to mixing devices having one or more chambers configured to revolve about a rotating axis to induce multidirectional and/or tri-axial movement of media within the chambers.

BACKGROUND

It is often desirable to mix a solid media with a liquid to, for example, cause a chemical reaction and/or to blend, mix, tumble, clean, scour, or combine various materials to a uniform and/or reaction-initiated end-product or by-product. For example, many processes require mixing of water with a solid granular media or resin. Likewise, the production of some pharmaceuticals requires mixing, blending, or reacting of powdered solids and liquids. Similarly, some water treatment processes require blending the water to be treated with polymer/flocculent solids and/or other anti-contaminant coagulations.

Many conventional mixing devices, however, do not provide adequate or a desirable level of mixing. For example, some conventional devices include a rotating circular chamber in which a solid media and liquid are mixed. Such devices induce mixing in only a single direction which can, for example, create a free-flowing surface layer of the solid media that inhibits adequate mixing as the chamber rotates. Accordingly, there is a need in the art for improved devices and methods for mixing media with liquids.

BRIEF DESCRIPTION OF THE DRAWINGS

Many aspects of the present technology can be better understood with reference to the following drawings. The components in the drawings are not necessarily to scale. Instead, emphasis is placed on illustrating clearly the principles of the present technology.

DETAILED DESCRIPTION

Figure 1A:
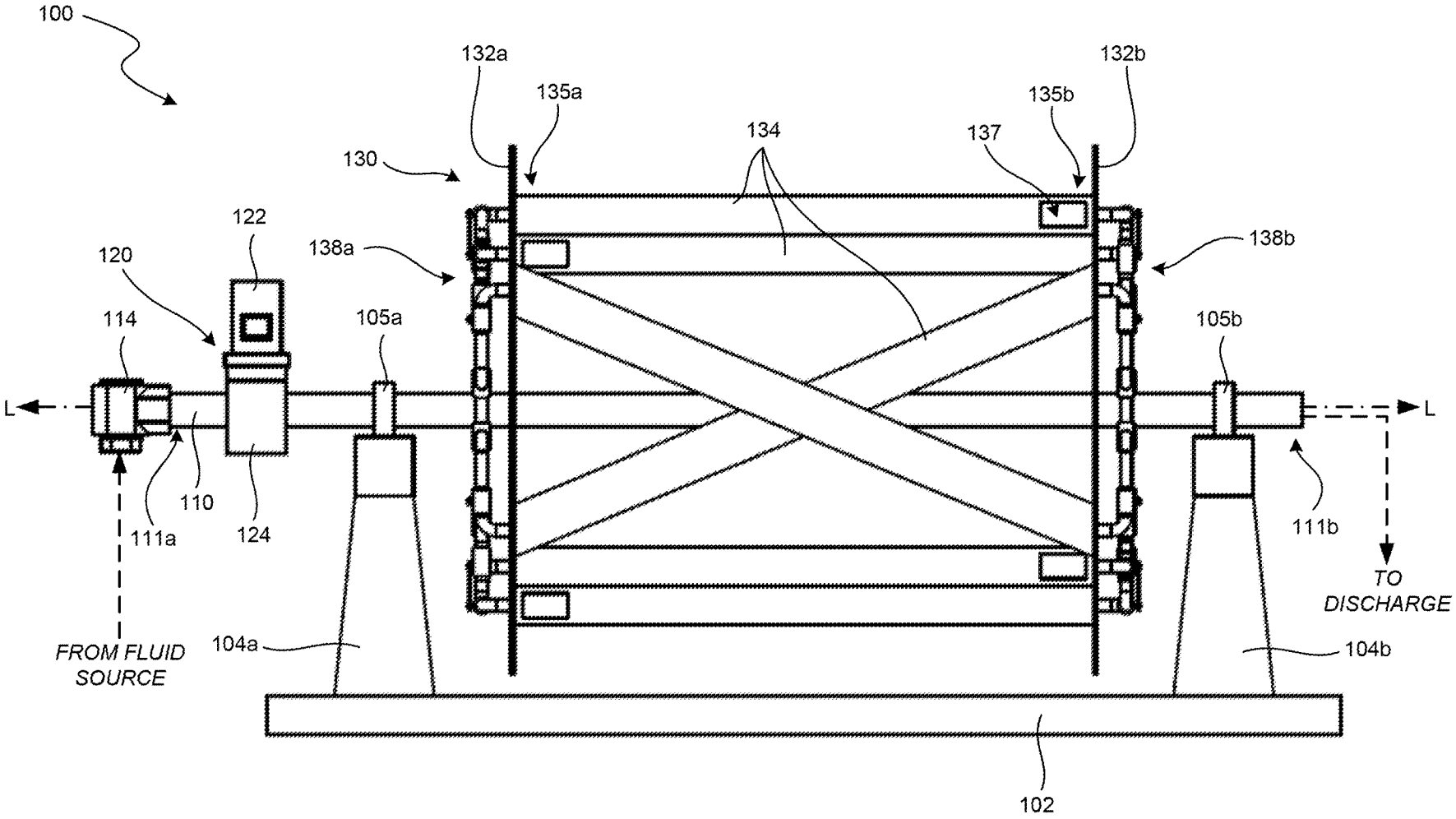
FIGS. 1A-1D are a side view, a top view, a front isometric view, and a rear isometric view, respectively, of a mixing device configured in accordance with an embodiment of the present technology.
Figure 1B:
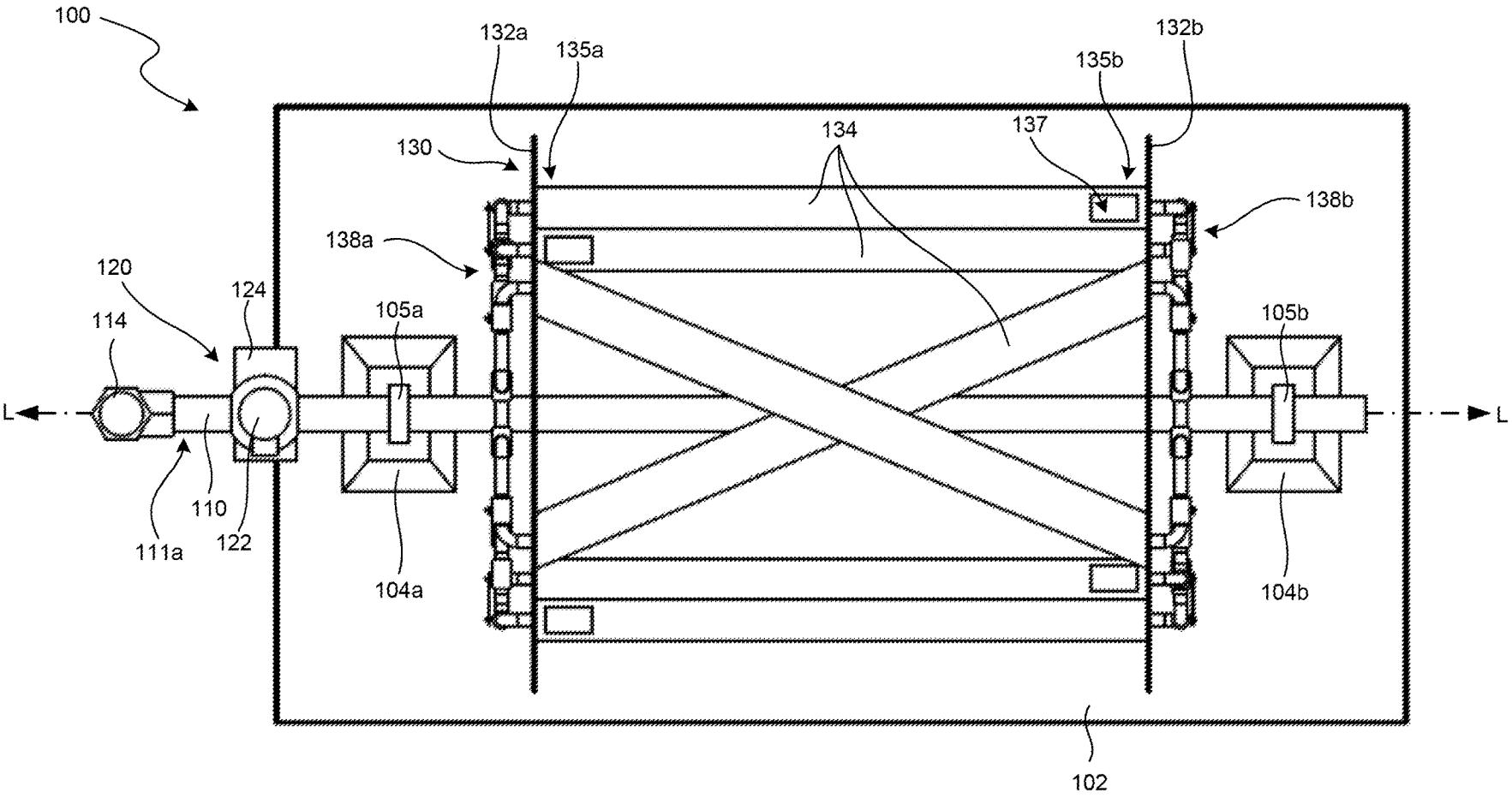

Aspects of the present disclosure are directed generally toward mixing devices and associated methods. In several of the embodiments described below, for example, a mixing device includes a spindle configured to rotate about a longitudinal axis and a plate attached to the spindle. The device can further include an enclosure-such as an elongate tube-mounted to the plate at an oblique angle. The enclosure defines an interior chamber (e.g., a reaction chamber) configured to receive a media and a fluid. Rotation of the spindle can drive the plate to rotate and the enclosure to revolve about the longitudinal axis to move (e.g., tumble) the media within the chamber and to mix the media with the fluid in the chamber. In some embodiments, the mixing device can include a second plate attached to the spindle, and the enclosure can extend between and be mounted at opposing ends to both plates.

In several of the embodiments described below, a mixing device can mix fluids, slurries, and/or supercritical pumpable matters with a solid granular media in a batch, continuous, or variable fluid flow mode of operation. For example, the mixing device can include at least one mixing chamber configured to induce multidirectional (e.g., tri-axial movements) of the materials to be mixed or contacted. In some embodiments, the mixing chamber is obliquely angled relative to a longitudinal axis and is configured to revolve around the longitudinal axis such that the chamber oscillates vertically from end-to-end with each revolution to cause a continuous destabilization in the angle of repose of a solid granular media within the chamber. The chamber can also have a cross-sectional geometry that, during revolution of the chamber, further causes a continuous destabilization in the angle of repose of the granular media within the chamber. In some embodiments, for example, the chamber can have a rectangular cross-sectional shape including opposing sidewalls and opposing floors. In such embodiments, the granular media migrates by gravity to a stable slope as the chamber floor moves to a sidewall orientation, and the approaching sidewall becomes the chamber floor in a repeating manner. Therefore, the alternating sidewall-floor-sidewall-floor dimensions of the obliquely revolving rectangular chamber can further cause disruptive mixing as the fall line of destabilized material in the chamber is non-congruent through a complete revolution of the chamber.

In some embodiments, the fluid, slurry, and/or supercritical matter ("fluid") can be continuously or variably fed into one end of the chamber during revolution of the chamber. In such embodiments, the fluid can generate mixing force vectors as the chamber continually changes its geospatial orientation relative to gravity and the fluid passes through and around the media within the chamber before the fluid is discharged from the opposite end of the chamber. The mixing device can be operated in continuous, intermittent, or variable flow, or batch modes to, for example, mix slurries, liquids, mixtures, or supercritical liquids with granular solid material and/or to cause reactions between the same as may be desired.

Specific details of several embodiments of the present technology are described herein with reference to FIGS. 1A-3E. However, the present technology may be practiced without some of these specific details. In some instances, well-known structures and techniques have not been shown in detail so as not to obscure the present technology. The terminology used in the description presented below is intended to be interpreted in its broadest reasonable manner, even though it is being used in conjunction with a detailed description of certain specific embodiments of the disclosure. Certain terms may even be emphasized below; however, any terminology intended to be interpreted in any restricted manner will be overtly and specifically defined as such in this Detailed Description section.

The accompanying Figures depict embodiments of the present technology and are not intended to be limiting of its scope. The sizes of various depicted elements are not necessarily drawn to scale, and these various elements may be arbitrarily enlarged to improve legibility. Component details may be abstracted in the Figures to exclude details such as position of components and certain precise connections between such components when such details are unnecessary for a complete understanding of how to make and use the present technology. Many of the details, dimensions, angles, and other features shown in the Figures are merely illustrative of particular embodiments of the disclosure. Accordingly, other embodiments can have other details, dimensions, angles, and features without departing from the spirit or scope of the present technology. The headings provided herein are for convenience only and should not be construed as limiting the disclosed subject matter.

A. Selected Embodiments of Mixing Devices and Associated Methods

FIGS. 1A-1D are a side view, a top view, a front isometric view, and a rear isometric view, respectively, of a mixing assembly or device 100 ("device 100") configured in accordance with an embodiment of the present technology. In some embodiments, the device 100 can be referred to as a tumbler. Referring to FIGS. 1A-1D together, the device 100 includes a platform or base 102, a front or first stanchion 104*a* coupled to and extending generally vertically from the base 102, and a rear or second stanchion 104*b*coupled to and extending generally vertically from the base 102. A spindle 110 is rotatably coupled to the stanchions 104*a, b* via a first bearing 105*a* and a second bearing 105*b*, respectively. A drive mechanism 120 can be coupled to the spindle 110 and configured to drive the spindle 110 to rotate about a longitudinal axis L extending coaxially therethrough. A swivel 114 can be coupled to a first end portion 111*a* of the spindle 110 and can be fluidly coupled to a fluid source (shown schematically in FIG. 1A) for supplying one or more fluids to the device 100. As further shown in FIGS. 1A-1D, a chamber assembly 130 is (i) mechanically coupled to the spindle 110 and (ii) fluidly coupled to the fluid source. In operation, the drive mechanism 120 is configured to rotate the spindle 110 to thereby rotate/revolve the chamber assembly 130 about the longitudinal axis L.

The bearings 105*a, b* are securely coupled (e.g., permanently attached) to the stanchions 104*a, b*, respectively, and configured to support and allow for the rotation of the spindle 110 and the chamber assembly 130. Accordingly, the bearings 105*a, b* can be constructed to withstand (i) a maximum (e.g., fully loaded) mass of the device 100, (ii) varying rotational speeds of the spindle 110, and/or (iii) the intended environment in which the device 100 is to operate. In some embodiments, the bearings 105*a, b* enable unimpeded rotation of the spindle 110 with as little friction as is practical. In some embodiments, the base 102 is configured to at least partially withstand some unbalanced rotation of and/or vibration of the spindle 110 and chamber assembly 130. In some embodiments, the base 102 can include a drip pan or vault (e.g., positioned below the chamber assembly 130) for catching or containing fluid leaks or drips from the device 100 during maintenance and servicing. In some embodiments, the device 100 can include shock pads, pistons, springs, torsion bars, and/or other energy and/or vibration absorption devices. Such devices can be applied to and/or installed, for example, between the bearings 105*a, b*, and/or to the bottom side of the base 102 (e.g., where the base 102 interfaces a level, adequately designed, structurally sound, and amply constructed grade pad). In some such embodiments, the device 100 can include additional anchoring and/or stabilizing features to keep the device 100 level and/or to accommodate or damp vibrations.

Figure 1D:
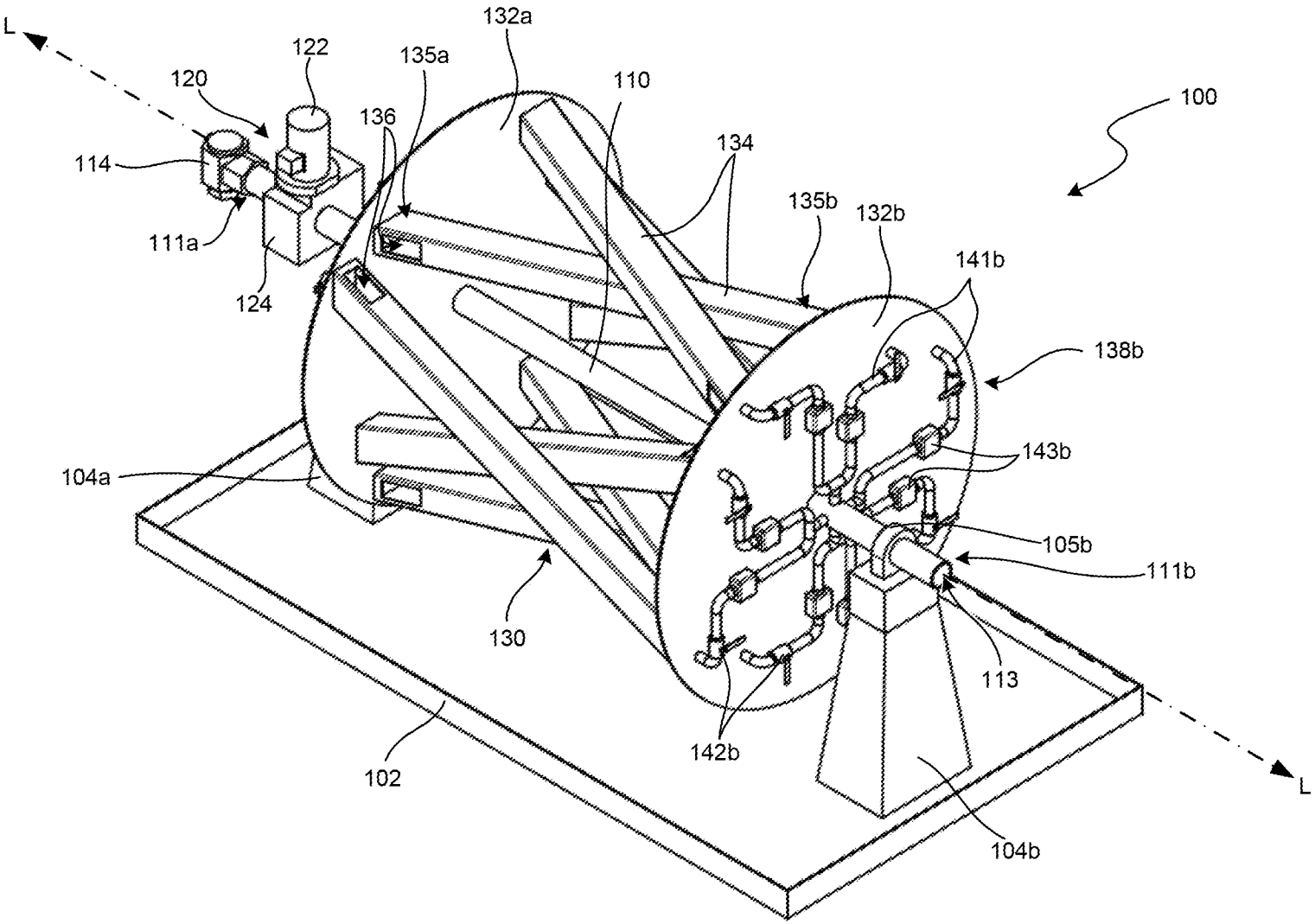
Figure 2:
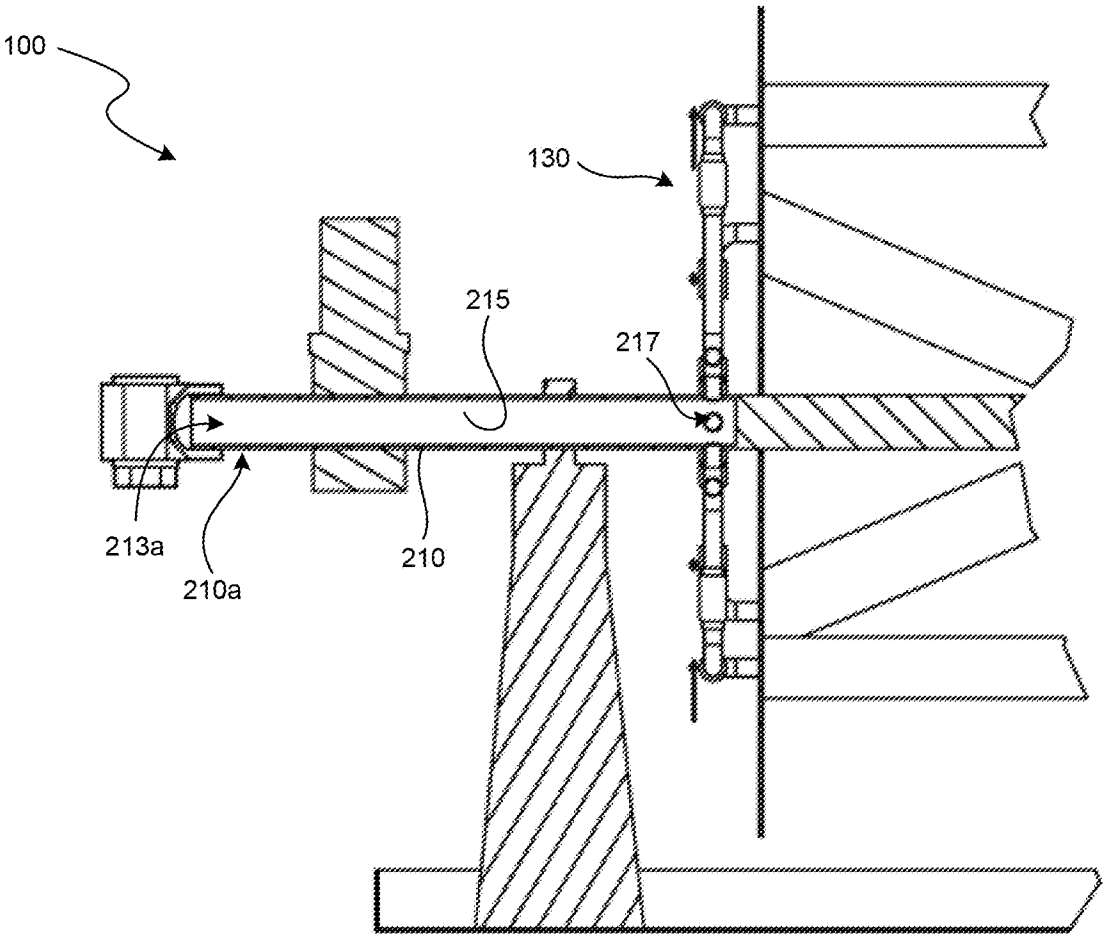
FIG. 2 is a partial side cross-sectional view of the mixing device shown in FIGS. 1A-1D having a spindle configured in accordance with another embodiment of the present technology.

The spindle 110 includes the first end portion 111*a* and a second end portion 111*b* opposite the first end portion 111*a*. In some embodiments, the spindle 110 is a hollow tube (e.g., a hollow-core Shelby tube) having a bore 113 (FIG. 1D) extending longitudinally therethrough from the first end portion 111*a* to the second end portion 111*b*. In other embodiments, the spindle 110 can be a solid or substantially solid rod having bores (e.g., cylindrical chambers) extending at least partially therethrough and exposed at the end portions 111*a, b* of the spindle 110. FIG. 2, for example, is a partial side cross-sectional view of the device 100 having a spindle 210 configured in accordance with another embodiment of the present technology. In the illustrated embodiment, the spindle 210 includes a first bore 213*a* extending from a first end portion 211*a* of the spindle 210 to proximate the chamber assembly 130. The spindle 210 can include a similar second bore (not pictured) extending from a second end portion of the spindle 210 to proximate the chamber assembly 130. As further shown in FIG. 2, the spindle 210 can include a sidewall 215 having a plurality of openings 217 extending therethrough for supplying a fluid to/from the chamber assembly 130, as described in detail below.

Referring again to FIGS. 1A-1D, the swivel 114 is fluidly coupled to (i) the bore 113 of the spindle 110 (e.g., or the first bore 213*a* of the spindle 210 shown in FIG. 2) and (ii) the external fluid source for supplying a fluid (or another pumpable material) to the bore 113 of the spindle 110 and to the chamber assembly 130, as described in detail below. In some embodiments, the swivel 114 is configured to connect and convey a fluid from a stationary location to the rotating spindle 110 and the chamber assembly 130. The swivel 114 can be configured to withstand (i) a maximum operating pressure, temperature, loaded-mass, rotational speed, or other operating parameter or condition of the device 100, (ii) chemical properties and/or a physical consistency of a fluid supplied by the fluid source, (iii) properties and characteristics of the fluid feed and discharge, etc. In some embodiments, the swivel 114 allows for unimpeded rotation of the spindle 110 with as little friction as is practical. In the illustrated embodiment, the device 100 includes only the single swivel 114. In other embodiments, however, the device 100 can include a second swivel coupled to the second end portion 111*b* of the spindle 110 to facilitate, for example, discharging of a fluid pumped through the chamber assembly 130 to external piping (shown schematically in FIG. 1A).

In the illustrated embodiment, the drive mechanism 120 includes a motor 122 and a gear-reduction transfer box or case 124. The motor 122 can be any suitable motor, driver, etc., for driving rotation of the spindle 110 including, for example, an electric motor, hydraulic-powered driver, steam/compressed gas engine, petroleum combustion engine, etc. In a particular embodiment, for example, the motor 122 can be a hydraulic-powered driver as might be supplied from a pressurized fluid such as might be available at a dam or mine location with hydraulic head. The gear-reduction transfer case 124 is configured to provide appropriate power and torque to rotate the spindle 110 and the attached chamber assembly 130. The spindle 110 can have a geared, rifled, serrated, or other finished outer surface proximate the gear-reduction transfer case 124 to engage with the drive mechanism 120. In some embodiments, the spindle 110 can engage the gear-reduction transfer case 124 via a key-slot locking mechanism or another suitable interface. When driven by the drive mechanism 120, the spindle 110 applies torque from the drive mechanism 120 to the chamber assembly 130 which causes the chamber assembly 130 to rotate. In some embodiments, the spindle 110 can be driven at a constant, variable, and/or programmable rate and/or for a constant, variable, and/or programmable duration. In some embodiments, the drive mechanism 120 can be configured to provide adequate torque to the spindle 110 to rotate the spindle 110 for a prolonged or extended period of time (e.g., hours, days, weeks, etc.).

In the illustrated embodiment, the chamber assembly 130 includes a front or first plate 132*a* and a rear or second plate 132*b* that are each coupled to the spindle 110. More particularly, the spindle 110 can extend through a center of each of the plates 132*a, b*. In some embodiments, rotation of the spindle 110 causes the plates 132*a, b* to rotate at the same speed around the longitudinal axis L. In the illustrated embodiment, the plates 132*a, b* each have a generally circular shape, have the same dimensions, and are arranged parallel to one another. In other embodiments, the plates 132*a, b* can have other suitable shapes and configurations, and/or can be arranged differently with respect to each other and/or the spindle 110. In some embodiments, the drive mechanism 120 or an additional drive mechanism (not pictured) can be configured to directly interface with and drive one or both of the plates 132*a, b* rather than or in addition to the spindle 110. For example, the plates 132*a, b* can rest on rollers, or can be toothed to engage gears or another equivalent mechanical driver to allow for application of force to cause the plates 132*a, b* to rotate around their common centerline (e.g., the longitudinal axis L). In some such embodiments, exterior surfaces or edges of the plates 132*a, b* can be textured, geared, rifled, serrated, contoured, grooved, cogged, or otherwise finished with a friction enhancing surface that when placed on or in contact with the rollers, gears, or means of the drive mechanism, allow the drive mechanism to engage and drive the plates 132*a, b* to rotate.

Figure 1C:
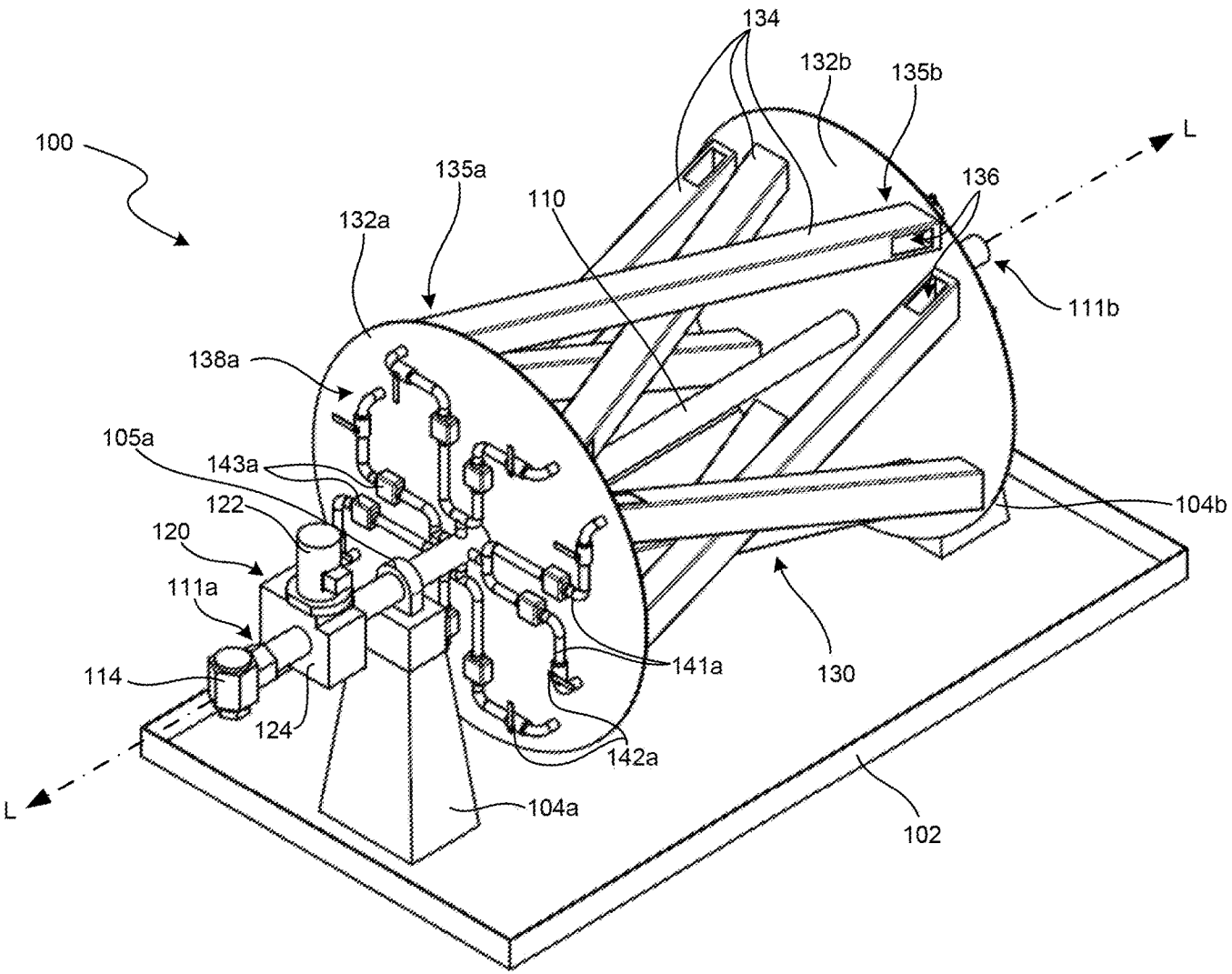

The chamber assembly 130 further includes a plurality of enclosures (e.g., elongate members, compartments, tubes, cylinders, reactors, etc.) 134 extending between and coupled to the plates 132*a, b*. More particularly, individual ones of the enclosures 134 can include a first end portion 135 a coupled to the first plate 132 a (e.g., coupled to a rear-facing surface of the first plate 132*a*) and a second end portion 135*b* coupled to the second plate 132*b*(e.g., coupled to a forward-facing surface of the second plate 132*b* that faces the rear-facing surface of the first plate 132*a*). As shown in the illustrated embodiment, the spindle 110 can extend at least between end portions of the chamber assembly 130, and/or the first plate 132*a* and second plate 132*b*. As also shown in the illustrated embodiment, the enclosures 134 are coupled to an outer peripheral portion of the first and second plates 132*a*, 132*b* and radially outward of the spindle 110. The enclosures 134 can be generally hollow members that define an interior chamber 136 (FIGS. 1C and 1D). The chambers 136 are configured to contain fluids, a fluidized bed, a supercritical fluid (pressurized gas), granular solids, particles or media, or house any of the aforementioned material or materials during operation of the device 100. Accordingly, the enclosures 134 can include openings or access ports 137 (FIGS. 1A and 1B) formed therein for receiving/exhausting some or all of the materials to be mixed.

In the illustrated embodiment, the access ports 137 are formed proximate to each of the end portions 135*a, b* of the enclosures 134 and offset from the cross-sectional centers of the enclosures 134 to allow for filling and vacating of media and/or fluid from the enclosures 134. In other embodiments, the enclosures 134 can include a different number of access ports 137, and/or the access ports 137 can be formed at other locations along the enclosures 134 (e.g., proximate to the center of the enclosures 134). In some embodiments, plates, covers, valves, viewing windows, gaskets, and/or other means (not pictured) can be securely placed over the access ports 137 after disposing the media in the chambers 136 and during operation of the device 100 (e.g., during revolution of the chamber assembly 130). In some embodiments, the chamber assembly 130 is configured to expose or otherwise all for easy access to the access ports 137 when the corresponding one of the enclosures 134 is at the top or bottom of a revolution about the longitudinal axis L.

Moreover, the enclosures 134 can include additional components for retaining the media within the chambers 136, for removing particle fines and residuals from the chambers 136, and/or for facilitating other intended reactions within the chambers 136. For example, the enclosures 134 can include discharge magnets, filters, secondary reaction contact chambers, drop-out boxes, settlers, clarifiers, etc. In some embodiments, for example, ultrasonic piezoelectric cells can be mounted on external surfaces of the enclosures 134 with power control units mounted within the rotating chamber assembly 130 and with power provided via a hollow shaft electric power slip ring in concert with the fluid feed swivel 114 fixed to the spindle 110. Likewise, ceramic, or electro-magnets can be mounted on the surfaces of enclosures 134 with power provided via a hollow shaft electric power slip ring in concert with the fluid feed swivel 114 fixed to the spindle 110. In other embodiments, such components can be incorporated into other locations of the device 100—for example, anywhere in and/or along a fluid path through the device 100.

The enclosures 134 can further include sample and/or drainage taps that can be located proximate one or both of the end portions 135*a, b* of the enclosures 134 or elsewhere. Such taps can be located at the lowest point of elevation possible when rotation of the chamber assembly 130 is stopped so that, for example, the chambers 136 may be completely drained into a container or released into the limits of a drip pad or vault beneath the device 100. In some embodiments, troughs or other features may be added to funnel material from the enclosures 134 into a collection hopper or container, and may also be used to fill the chambers 136 with the media.

In the illustrated embodiment, the enclosures 134 have a rectangular or cross-sectional shape including opposing first sides (e.g., sidewalls) and opposing second sides (e.g., floors) that are wider than the first sides. As described in greater detail below, during operation of the device 100, the rectangular cross-sectional shape of the enclosures 134 can minimize or reduce rotation of the media as a singular body mass within the chambers 136, and also inhibits or prevents the formation of large central surface mass vortices. However, in other embodiments, the enclosures 134 can have other cross-sectional shapes such as polygonal, circular, etc. In some embodiments, polygonal shapes having relative fewer sides are expected to provide better mixing results while also increasing the structural strength of the device 100. In some embodiments, the enclosures 134 can have flites, lifts, paddles, blades, and/or other suitable features that extend at least partially within the chambers 136 to facilitate mixing of the media with a fluid. In certain embodiments, however, the enclosures do not include any such devices and mixing is facilitated solely by the geometry and movement (e.g., revolution) of the enclosures 134.

As further shown in FIGS. 1A-1D, the enclosures 134 are obliquely angled relative to the plates 132*a, b*. More particularly, individual ones of the enclosures 134 are coupled to the plates 132*a, b* such that either (i) the first sides of the enclosure 134 are generally perpendicular to the plates 132*a, b* and the second sides of the enclosure 134 are on an angle of inclination off level from the plates 132*a, b* (and the longitudinal axis L) or (ii) the second sides of the enclosure 134 are generally perpendicular to the plates 132*a, b* and the first sides of the enclosure 134 are on an angle of inclination off level from the plates 132*a, b*. In other embodiments, all of the sides of the enclosures 134 can be obliquely angled relative to the longitudinal axis L and the plates 132*a, b*. The angle of inclination of the enclosures 134 relative to the plates 132*a, b* can be selected to be sufficient to allow gravity to affect the media contained within the chambers 136 of the enclosures 134 during rotation of the chamber assembly 130. For example, the angle of inclination can be sufficient to cause the media to fall or slough within the chambers 136 (*i*) during rotation of the chamber assembly 130, (ii) while the chamber assembly 130 is stationary, (iii) without fluid in the chambers 136, (iv) with fluid in the chambers 136, and/or (v) during fluid flow through the chambers 136. In some embodiments, the chambers 136 can form an angle of between about 5°-55°, between about 20°-30° (e.g., about 22.5=), etc., relative to the plates 132*a, b* and/or the longitudinal axis L. In some embodiments, the orientation of the enclosures 134 relative to the plates 132*a, b* ensures that, during rotation of the chamber assembly 130, there is no planar surface of any one of the enclosures 134 that is level on any two dimensions with the longitudinal axis L.

In some embodiments, the angle of inclination can be designed or optimized based on the properties of the media and/or fluid to be mixed. For example, the angle of inclination may be selected or adjusted as needed to surpass the stability declination slope for a chosen media in a chosen fluid. For example, the angle of inclination of the elongate members 134 can be increased to increase the slope the media traverses during rotation of the chamber assembly 130. In some embodiments, the angle of inclination is selected (i) to exceed the stability slope of an angle of repose of the media (e.g., the steepest stable slope of the surface of the media that the media is able to maintain without sloughing due to gravity) in the chambers 136 and (ii) to accommodate the geometry of the enclosures 134 within an acceptable space for installation and operation of the device 100.

In the illustrated embodiment, the enclosures 134 are arranged in pairs such that each pair forms an "X" and is fixed to corresponding quadrants of the plates 132*a, b*. That is, individual pairs of the enclosures 134 can cross radially by one another relative to the longitudinal axis L. In some embodiments, the "X" alignment of the pairs of the enclosures 134 provides structural bracing for the plates 132*a, b* that increases the strength of the device 100. In the illustrated embodiment, for each pair of the enclosures 134, one of the enclosures 134 is mounted nearer to the perimeter of the plates 132*a, b* than the other of the enclosures 134 in the pair. Moreover, for each pair of enclosures 134, the angle of inclination is replicated to provide an equivalent (but opposite) spatial orientation pattern during each revolution of the chamber assembly 130. In addition, the common centerline through the point at which each pair of the enclosures 134 cross can form an angle of about 90° relative to the centerlines of other pairs of the enclosures 134.

Therefore, during rotation of the chamber assembly 130, the enclosures 134 are in rotational balance relative to (i) the longitudinal axis L and (ii) a plane extending through the points at which each pair of the enclosures 134 cross. That is, the geometry of the plates 132*a, b* and the enclosures 134 is counterbalanced to allow for smooth and uniform rotation of the chamber assembly 130 around the spindle 110 and the longitudinal axis L. The counterbalanced configuration of the chamber assembly 130 can minimize the energy and force needed to start and maintain rotation of the chamber assembly 130, while also allowing the chamber assembly 130 to revolve smoothly around the longitudinal axis L without requiring an uneven force to rotate the chamber assembly 130 and/or without causing excessive vibration or unweighting during rotation. In other embodiments, the chamber assembly 130 can include more or fewer than the four illustrated pairs of enclosures 134 (e.g., one pair, two pairs, more than four pairs, etc.), or the chamber assembly 130 can include an odd number of the enclosures 134. In some such embodiments, an odd number of enclosures 134 are arranged about the longitudinal axis L such that the chamber assembly 130 is counterbalanced (e.g., with the enclosures equally spaced axially and radially about the longitudinal axis L).

The enclosures 134 can be constructed from a variety of materials to prevent their degradation from chemical and physical properties of, for example, the media and fluid to be mixed, the by-products and/or end-products derived from the contact and mixing of the media and the fluid, and/or the desired operating temperatures and pressures. For example, the enclosures 134 can be jacketed and insulated to control temperature, and/or coated to enhance longevity. For example, the interior surface of the enclosures 134 can be appropriately coated (e.g., epoxied, powder coated, etc.) based on the anticipated chemical and physical activity of the fluid and media to be mixed (e.g., for chemical compatibility, protection against abrasion, etc.). In general, the number of enclosures 134, and the length, cross-sectional dimensions, side wall thicknesses, mounting angles (e.g., of inclination), etc., of the enclosures 134 can be selected to accommodate the desired outcome or outcomes of the mixing and interaction of the fluid with the media. In some embodiments, these properties are selected such that the enclosures 134 have a geometry that is balanced relative to the longitudinal axis L when the media and fluid are within the chambers 136.

The chamber assembly 130 further includes a fluid conveyance system including, for example, a first tubing system 138*a* (e.g., an intake system) and a second tubing system 138*b* (e.g., an exhaust or discharge system) that fluidly couple the chambers 136 of the enclosures 134 to the bore 113 of the spindle 110. In the illustrated embodiment, the first tubing system 138*a* fluidly couples the first end portions 135*a* of the enclosures 134 to the spindle 110, and the second tubing system 138*b* fluidly couples the second end portions

135*b* of the enclosures 134 to the spindle 110. More specifically, as best seen in FIG. 1C, the first tubing system 138*a* can include individual first fluid lines 141*a* (e.g., comprising pipes, tubes, elbows, nipples, crosses, "T's," splitters, connectors, etc.) that fluidly couple the spindle 110 to corresponding ones of the enclosures 134 (e.g., to the first end portions 135*a* of the enclosures 134). The first fluid lines 141*a* can include one or more first valves 142*a*, first flow meters 143*a*, and/or other suitable components. In the illustrated embodiment, the first fluid lines 141*a* extend through or fluidly couple to holes or openings in (i) the spindle 110, (ii) the first plate 132*a*, and/or (iii) the first end portions 135*a* of the enclosures 134. In some embodiments, all or a portion of the first tubing system 138*a* can be coupled to (e.g., secured to) the first plate 132*a* to inhibit or prevent movement of the first tubing system 138*a* during rotation of the chamber assembly 130.

The second tubing system 138*b* can include features generally similar to the features of the first tubing system 138*a*. As best seen in FIG. 1D, for example, the second tubing system 138*b* can be coupled to a rear-facing surface of the second plate 132*b* and can include individual second fluid lines 141*b* that fluidly couple the spindle 110 to corresponding ones of the enclosures 134 (e.g., to the second end portions 135*b* of the enclosures 134). Likewise, the second fluid lines 141*b* can include one or more second valves 142*b*, second flow meters 143*b*, and/or other suitable components. In some embodiments, the tubing systems 138*a, b* can be identical, symmetric, etc. In operation, the tubing systems 138*a, b* enable the controlled directional and equivalent flow of a fluid into and out of the enclosures 134.

In some embodiments, the fluid conveyance system (e.g., the tubing systems 138*a, b*) can further include additional components such as gas traps, pressure relief valves, inline monitoring sensors, and/or other control features and/or mounts. These features may be incorporated into the swivel 114, the spindle 110, or the conveyance piping/tubing between the spindle 110 and the chamber assembly 130. For example, gas traps and/or pressure relief valves can be positioned beyond the greatest radius of corresponding ones of the enclosures 134 to allow for the release, capture, and/or collection of gas and/or liquids when these components are positioned (e.g., during rotation of the chamber assembly 130) at and/or below the corresponding ones of the enclosures 134. Moreover, in some embodiments, the fluid conveyance system can include mechanical cavitation nozzles, spiral flow initiators, and/or other suitable components for delivering the fluid to the chambers 136 to provide desired mixing and/or reactions within the chambers 136 (e.g., to provide cavitation, enhance turbulent flow, etc.). In general, the components of the fluid conveyance system can be mounted on the outer surfaces of the plates 132*a, b* for ease of access and service.

During operation of the device 100, fluid can flow (i) from the fluid source through the swivel 114 and into the bore 113 of the spindle 110, (ii) from the bore 113 through the first tubing system 138*a* and into the chambers 136 of the enclosures 134, (iii) from the first end portions 135*a* of the chambers 136 to the second end portions 135*b* of the chambers 136 and into the second tubing system 138*b*, and (iv) from the second tubing system 138*b* into the bore 113 of the spindle 110. In some embodiments, the fluid then discharges by gravity from the hollow bore 113 or the bored-out rod spindle (FIG. 2) into a tank or receiving basin, or through another swivel that is fixed to the second end portion 111*b* of the spindle 110 and into piping via pressure supplied by the fluid source. Notably, the tubing systems 138*a, b* allow for splitting of the fluid flow into and out of the plurality of chambers 136. Fluid flow into, through, and/or out of the chambers 136 may be constant, variable, intermittent, or in batch, and/or set at different split flow allocation ratios between the various chambers 136 (e.g., by actuation of the valves 142*a, b* controlling fluid flow into and/or out of individual ones of the chambers 136). In some embodiments, the spindle 110, the tubing systems 138*a, b*, and the enclosures 134 can configured to withstand operating pressures of, for example, over 2000 psi.

Operation of the device 100 during a mixing and/or reaction process is now described with continued reference to FIGS. 1A-1D. First, one or more of the chambers 136 of the enclosures 134 are loaded with a media, such as a solid media, via the openings (e.g., access ports) 137 in the enclosures 134. The enclosures 134 can be filled with the same or differing amounts of the media, and/or filled with different types of media. In some embodiments, individual ones of the enclosures 134 are filled with an equivalent or substantially equivalent mass and/or volume of media so that the mass of the chamber assembly 130 is counterbalanced. In some embodiments, the media can be granular particles, fines, or pieces that will fall as a stream due to gravity and/or from being carried by the fluid. Solid media and/or their surfaces can be smooth, textured, uniform, non-uniform, angular, soft, hard, friable, sacrificial, dimensionally stable, particulate, agglomerated, reactive, or the like. Catalytic materials may also be disposed within the enclosures 134 to provoke or enhance reactions between the media and the fluid.

Before or after beginning rotation of the chamber assembly 130, the fluid from the fluid source can be introduced into the chambers 136 as described in detail above. In some embodiments, the fluid can be a liquid, gas, or supercritical liquid, or combinations or mixtures thereof. The fluid can have and/or can be introduced to the media in the chambers 136 with any suitable temperature, pressure, pH, density, viscosity, molecular polarity, miscibility, volatility, composition (e.g., inorganic or organic chemistry), and/or reactivity, and can be single or multi-phased. In some embodiments, the enclosures 134 are filled with an equivalent or substantially equivalent mass or volume of the fluid so that the revolving mass of the enclosures 134 is counterbalanced with respect to each other about the longitudinal axis L, and from the first plate 132*a* to the second plate 132*b*. Therefore, the chambers 136 can be equivalently filled with fluid and solid media with respect to their respective volume, mass, and/or other properties with an intent to further contribute to balance of the chamber assembly 130 as it rotates during operation. As described above, the fluid volume within the enclosures 134 may be fixed for batch operation (e.g., with the valves 142*a, b* closed), or provided at a continuous, steady, variable, or intermittent rate of flow to the chambers 136.

Rotation of the chamber assembly 130 continually changes the directions and magnitudes (e.g., vectors) of the forces incident upon the media in the chambers 136 to mix the media with the fluid in the chambers 136. For example, revolution of the chamber assembly 130 imparts multiple, cyclically changing forces on the media in the chambers 136 that causes the media to move (e.g., tumble, fall, slough, etc.) (i) lengthwise through the chambers 136 (e.g., between the end portions 135*a, b*), and (ii) rotationally around or about the rectangular cross-section of the chambers 136. In some embodiments, mixing is further accomplished by the movement of the fluid through the chambers 136. For example, the velocity and solid-material carrying capacity of the fluid can cause further mixing with the media as the media tumbles within the chambers 136.

More specifically, because the enclosures 134 are mounted at an oblique angle to the plates 132*a, b*, rotation of the chamber assembly 130 about the longitudinal axis L causes the enclosures 134 to oscillate vertically along their lengths. That is, the first end portions 135*a* of the enclosures 134 periodically cycle between being higher and lower relative to the second end portions 135*b* of the enclosures 134 (and vice versa). Thus, the enclosures 134 undulate between positive and negative inclinations to horizontal level during revolution of the chamber assembly 130, which causes the media in the chambers 136 to move by gravity within the fluid in both directions (e.g., toward the plates 132*a, b*) along the length of the chambers 136 as the slopes of the enclosures 134 cyclically undulate through positional changes during revolution.

Rotation of the chamber assembly 130 also causes the sides or surfaces of the enclosures 134 to change their relationship to gravity such that the media in the chambers 136 will fall or flow to seek a level position within the revolving chambers 136 due to the fall of gravity and the angle of repose of the media. For example, a granular solid media will fall or slough due to the instability of the slope of repose caused by lateral position changes of the floors/sidewalls of the chambers 136, and will seek level due to gravity during the 360° revolution of the enclosures 134 around the longitudinal axis L. In the illustrated embodiment in which the enclosures 134 have a rectangular cross-sectional geometry, the distance differences between adjacent sidewalls and floors (e.g., a first side and an adjacent second side) of the enclosures 134 can create short and long fall distances for the media that can generate a tri-axial spiral fall pattern for the media as the enclosures 134 revolve obliquely around the longitudinal axis L. In contrast, if the enclosures 134 have a circular cross-sectional geometry, the end-to-end oscillation of the media caused by revolution of the obliquely mounted enclosures 134 can cause mixing, however, with respect to solid media within the chamber, it has the potential of creating a free-flowing surface layer and distinct small particle paths as the (e.g., single) sidewall of each of the chambers 136 revolves. In some embodiments including enclosures 134 having circular or generally circular geometries, mixing can be improved by incorporating flites, lifts, baffles paddles, blades, or other features to the internal surfaces of the chambers 136.

Thus, it is expected that including mixing chambers having a rectangular or other polygonal cross-sectional shape will facilitate greater mixing and less granular segregation by inhibiting the creation of a free-flowing surface layer of the media within the chambers. In particular, the rectangular geometry of the enclosures 134 can create a non-congruent fall line that continually destabilizes the media in the chambers 136 during revolution to minimize rotation of the media as a singular body mass within the chambers 136, as well as preventing the formation of large central surface mass vortices within the chambers 136. Therefore, in some embodiments, the chambers 136 do not—and need not-include flites, lifts, baffles paddles, blades, or other features to influence the mixing or blending of the liquid and media.

In general, mixing of the media and fluid can be automatically (e.g., by a controller) or manually controlled to achieve a desired level of mixing, a specified reaction, or other property. For example, the geometry and construction of the chamber assembly 130, the rotational speed of the chamber assembly 130, the pressure of the fluid, the velocity of the fluid, the volume of fluid flow, operating temperatures, operating pressures, etc., can be controlled and/or specifically designed to achieve a desired mixing result. Moreover, additional components can be incorporated into the device 100 such as, for example, baffles, media screens, filters, drop-outs on discharge piping, ultrasonic piezometers, magnets, feed flow chamber nozzles (e.g., helical flow inducers, mechanical cavitation, self-cleaning, etc.), temperature control and/or pressure relief vent housing, observation portals, monitoring and control device actuation signal transmitters/receivers, etc. In some embodiments, meters and instrumentation can be provided to control and monitor fluids, solid media, and mixing, and reaction outcomes or end-products including pH, temperature, pressure, turbidity, and other parameters. For example, the device 100 can include one or more scales, levels, inclinometers, load-cells, liquid/gas injection ports, etc. In some embodiments, temperature, pressure, and other monitoring parameter sensors can be mounted into the chamber through the plates 132*a, b* or directly through sidewalls of the enclosures 134. In some embodiments, a tachometer sensor or gauge can monitor rotation of the spindle 110. Some or all of the sensors can transmit signals to a receiving data logger and/or a controller positioned external to the rotating components of the device 100. In some embodiments, the device 100 can include a pressure relief valve or system that can be used, for example, when the device 100 is operated as a closed system where both feed and discharge valves are closed during operation (e.g., during batch operation).

In some embodiments, all or a portion of the device 100 can be installed within a larger housing or shroud. The housing can be configured to provide temperature control (e.g., heating or cooling), and/or can be configured to capture, contain, and control gases or vapors that may be released by the device 100 during operation (e.g., via pressure relief valves). In some embodiments, the bearings 105*a, b*, the drive mechanism 120, and/or the swivel 114 can be mounted outside of the housing and the spindle 110 can be inserted through one or more walls of the housing such that the chamber assembly 130 is positioned within the housing. In some embodiments, the device 100 may be placed on a transport vehicle or trailer and operated thereon.

B. Other Selected Embodiment of Mixing Devices and Associated Methods

In some embodiments, a mixing device configured in accordance with the present technology can include one or more enclosures obliquely mounted to only a single rotatable plate. FIGS. 3A-3D, for example, are a partially-exploded front isometric view, a rear isometric view, a side view, and a side cross-sectional view, respectively, of a mixing assembly or device 300 ("device 300") configured in accordance with another embodiment of the present technology. The device 300 includes several features generally similar to the features of the mixing device 100 described in detail above with reference to FIGS. 1A-2. For example, referring to FIGS. 3A-3D together, the device 300 includes a chamber assembly 330 coupled to a spindle 310 and configured to rotate about a longitudinal axis M. A drive mechanism (not pictured) can be configured to drive the spindle 310 to rotate about the longitudinal axis M to rotate the chamber assembly 330, and the spindle 310 can be supported on a base by one or more bearings (not pictured).

In the illustrated embodiment, the chamber assembly 330 includes a single plate 332 coupled to the spindle 310 and having a front or first side 333*a*, and a back or second side 333*b*. A plurality of enclosures 334 are mounted to the second side 333*b* of the plate 332. More specifically, Individual ones of the enclosures 334 include a first end portion 335*a* mounted to the plate 332 and a second end portion 335*b* opposite the first end portion 335*a*. In some embodiments, the first end portions 335*a* of the enclosures 334 can be mounted to the plate 332 proximate to a perimeter or outer edge of the plate 332. In some embodiments, the enclosures 334 can have identical dimensions and/or angles of inclination relative to the plate 332, and can be equally spaced radially and/or axially about the longitudinal axis M such that the chamber assembly 330 is counterbalanced. In such embodiments, rotation of the chamber assembly 330 can require a minimum amount of energy.

The enclosures 334 are generally hollow members that define interior chambers 336 (FIG. 3A) that can house a media and/or a fluid during operation of the device 300. The media can be inserted into and/or removed from the chambers 336 via access ports in the enclosures 334 that can be securely closed via covers 339 during operation. In the illustrated embodiment, the enclosures 334 (*i*) are mounted at an oblique angle relative to the plate 332 and (ii) have a rectangular cross-sectional shape. As described in detail above, this geometry is expected to enhance mixing between the media and a fluid within the chambers 336 during operation. While four enclosures 334 are pictured in FIGS. 3A-3D, any number (e.g., one, two, three, five, eight, etc.) of enclosures 334 can be mounted to the plate 332.

In some embodiments, the spindle 310 can include a hollow interior bore that is fluidly connected to an external fluid source (not pictured) via a first swivel 314*a* and a first (e.g., intake) pipe or tube 319*a*. In the illustrated embodiment, the chamber assembly 330 further includes a fluid conveyance system including, for example, a first tubing system 338*a* (e.g., an intake system) and a second tubing system 338*b* (e.g., an exhaust system) that are fluidly coupled to the enclosures 334. In general, the fluid conveyance system is configured to (i) convey the fluid to the chamber assembly 330, (ii) split the fluid into one or more of the chambers 336, and (iii) convey fluid discharged from the chambers 336 from the device 300.

Figure 3A:
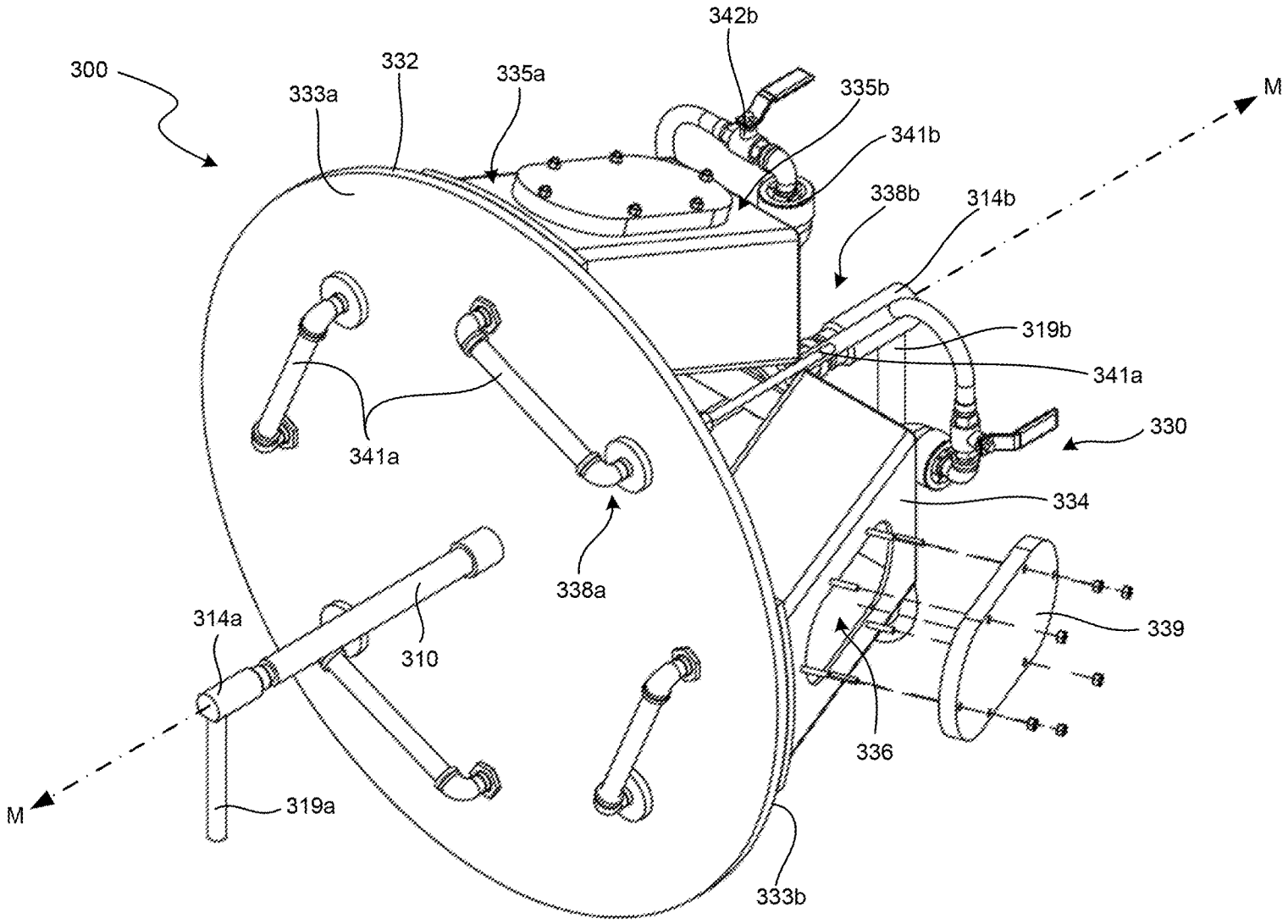
FIGS. 3A-3D are a partially-exploded front isometric view, a rear isometric view, a side view, and a side cross-sectional view, respectively, of a mixing device configured in accordance with another embodiment of the present technology.
Figure 3B:
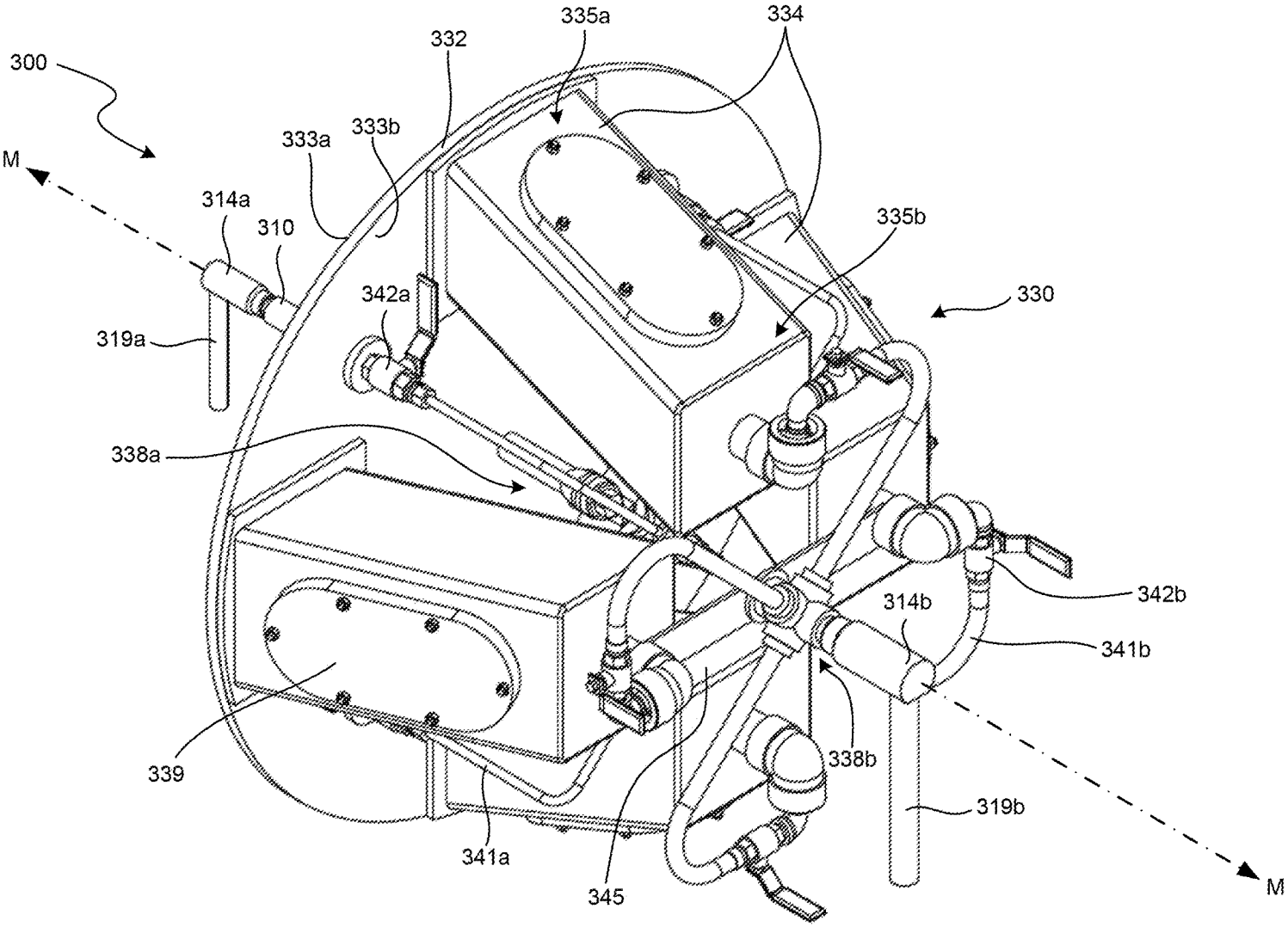
Figure 3C:
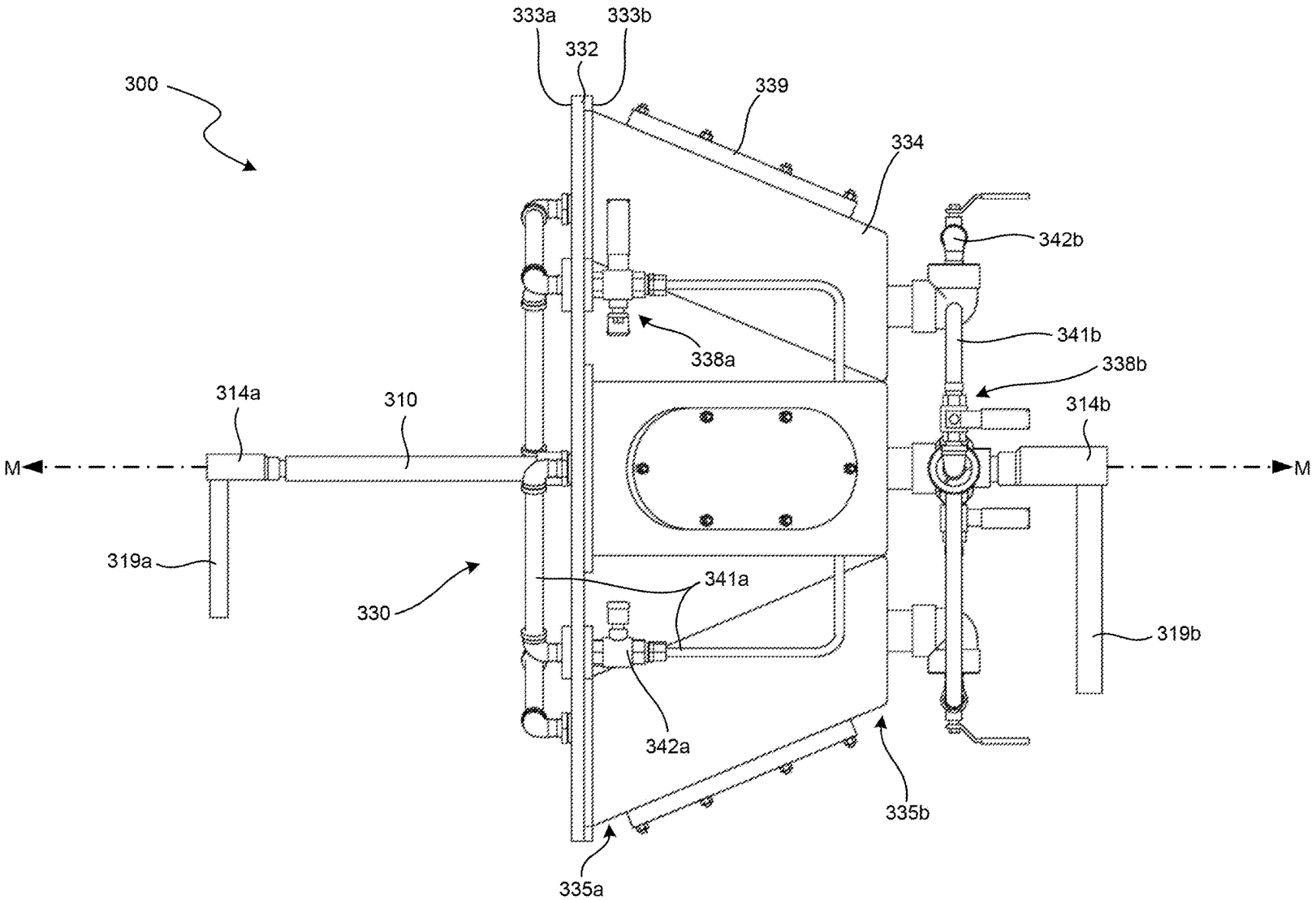
Figure 3D:
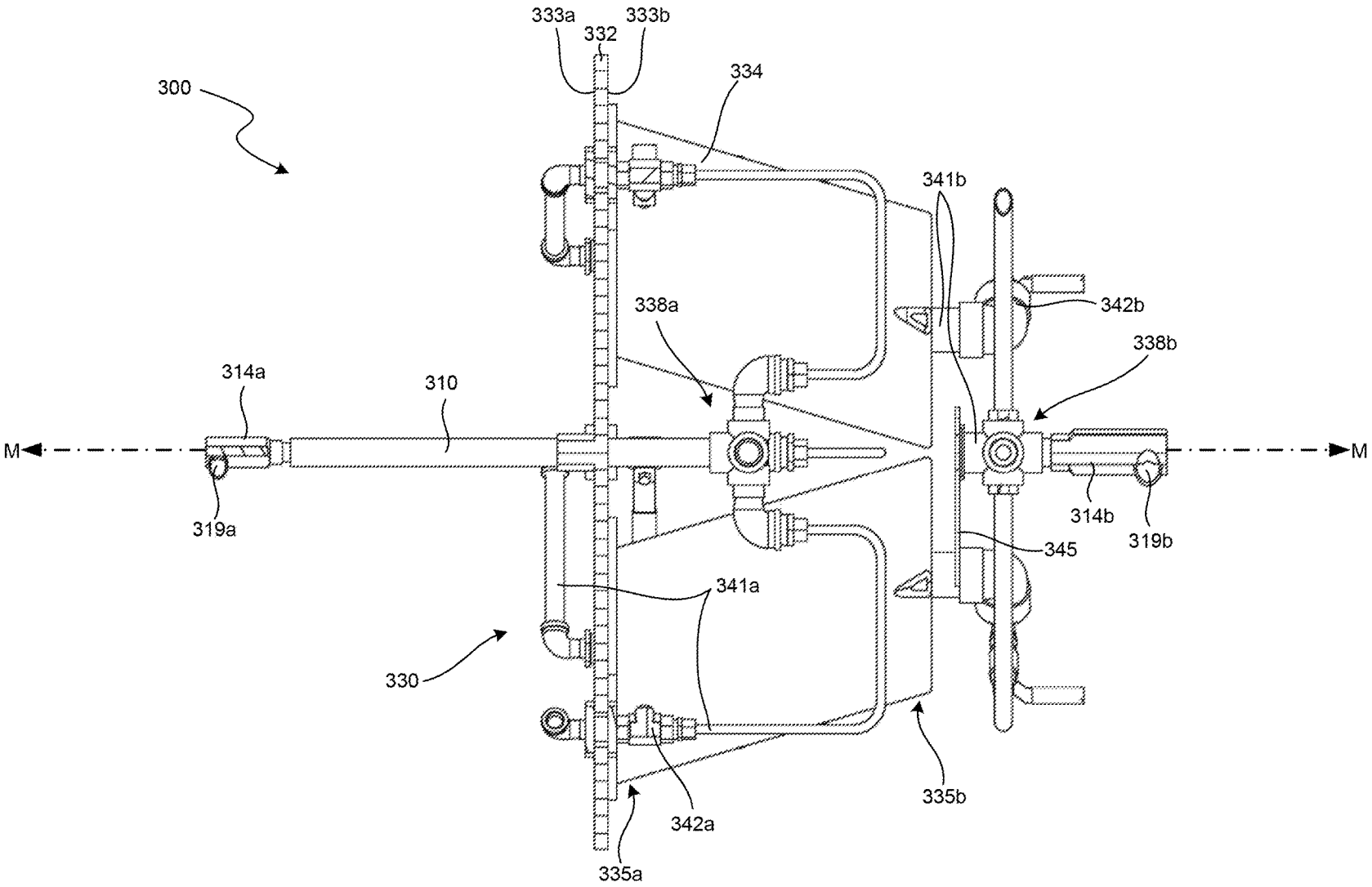
Figure 3E:
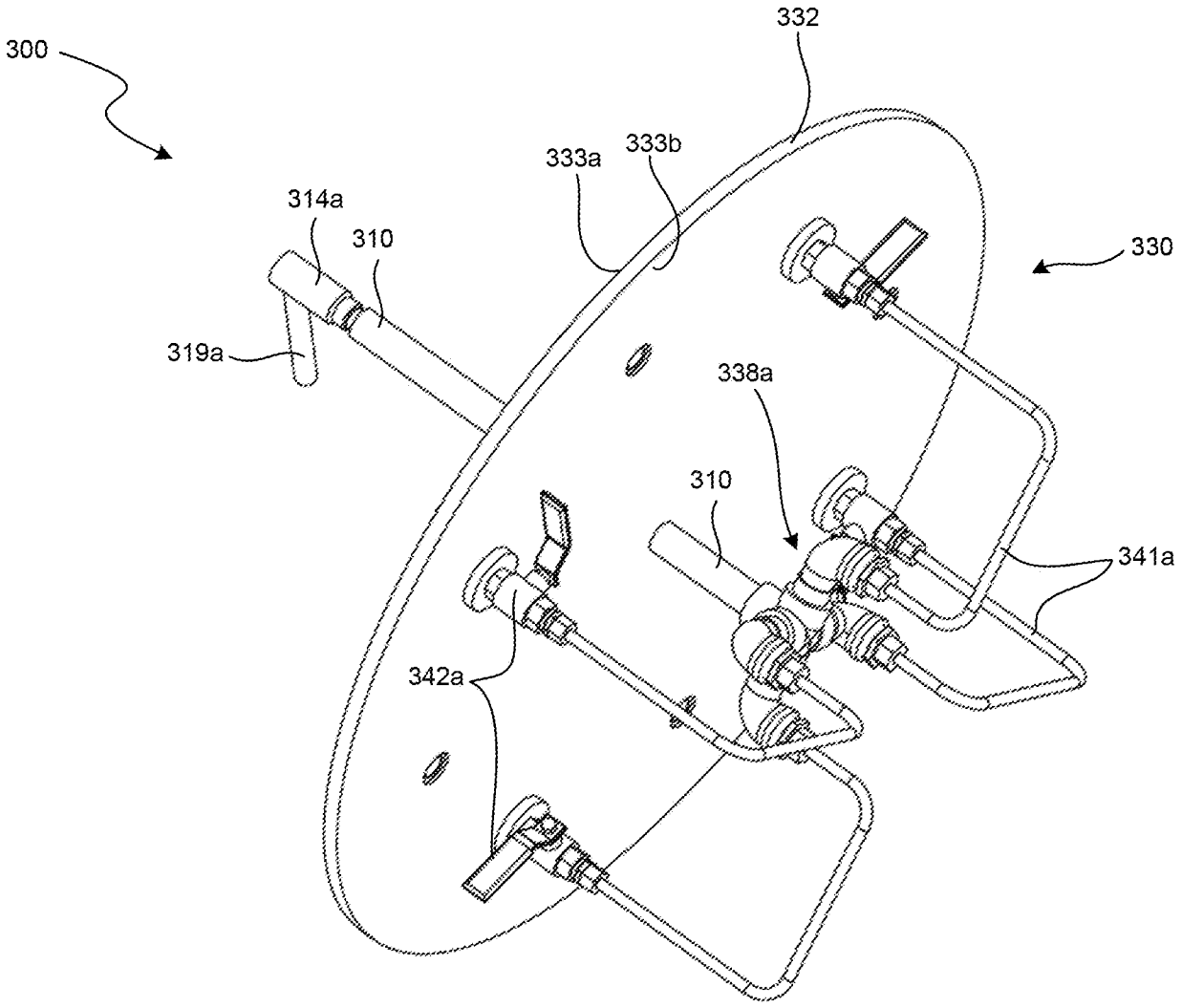
FIG. 3E is a simplified, rear isometric view of the device shown in FIGS. 3A-3D showing a tubing system configured in accordance with an embodiment of the present technology.

FIG. 3E is a rear isometric view of the device 300 with the enclosures 334 and second tubing system 338*b* removed to clearly illustrate some of the features of the first tubing system 338*a*. Referring to FIGS. 3A-3E together, the spindle 310 extends through (e.g., a center) of the plate 332, and the first tubing system 338*a* has individual first fluid lines 341*a* (e.g., comprising pipes, tubes, elbows, nipples, crosses, "T's," splitters, connectors, etc.) that fluidly couple the spindle 310 to corresponding ones of the enclosures 334. More particularly, in the illustrated embodiment, the first fluid lines 341*a* can extend through openings in the plate 332 (*i*) from the second side 333*b* of the plate 332 to the first side 333*a* of the plate 332 and (ii) from the first side 333*a* through the plate 332 to penetrate or otherwise fluidly connect to the first end portions 335*a* of the enclosures 334. In some embodiments, the first fluid lines 341*a* fluidly connect to a cross-sectional center of the enclosures 334. The first fluid lines 341*a* can further include one or more first valves 342*a*, flow meters, and/or other suitable components for controlling the fluid flow through the first tubing system 338*a*. In some embodiments, all or a portion of the first tubing system 338*a* can be coupled to the plate 332.

The second tubing system 338*b* can fluidly couple the second end portions 335*b* of the enclosures 334 to a second (e.g., outtake, discharge, etc.) pipe or tube 319*b* via a second swivel 314*b*. In other embodiments, the second tubing system 338*b* can fluidly couple the enclosures 334 to the spindle 310. The second tubing system 338*b* can include features generally similar to the features of the first tubing system 338*a*. In the illustrated embodiment, for example, the second tubing system 338*b* can include individual second fluid lines 341*b* that fluidly couple the second swivel 314*b* to corresponding ones of the enclosures 334 (e.g., to the second end portions 335*b* of the enclosures 334). Likewise, the second fluid lines 341*b* can include one or more second valves 342*b*, flow meters, and/or other suitable components for controlling the fluid flow through the second tubing system 338*b*. In some embodiments, all or a portion of the second tubing system 338*b* can be coupled to a crossbar 345. In the illustrated embodiment, the crossbar 345 extends between opposing ones of the enclosures 344 and provides mechanical support and stability for the second tubing system 338*b*.

During operation of the device 300, fluid can be pumped (i) from the fluid source through the first swivel 314*a* and into the bore of the spindle 310, (ii) from the bore through the first tubing system 338*a* and into the chambers 336 of the enclosures 334, (iii) from the first end portions 335*a* of the chambers 336 to the second end portions 335*b* of the chambers 336 and into the second tubing system 338*b*, and (iv) from the second tubing system 338*b* into the second swivel 314*b* to the outtake pipe 319*b*. Fluid flow into, through, and/or out of the device 300 may be constant, variable, intermittent, or in batch, and/or set at different split flow allocation ratios between the various chambers 336 (e.g., via actuation of the valves 342*a, b* controlling fluid flow into and/or out of individual ones of the chambers 336).

Operation of the device 300 during a mixing and/or reaction process can be generally similar to the operation of the device 100 described in detail above with reference to FIGS. 1A-1D. For example, the enclosures 334 can be loaded with a media and a fluid can be introduced to the chambers 336 continually, intermittently, or as a single batch during operation. Rotation of the chamber assembly 330 about the longitudinal axis M can cause the enclosures 334 to cyclically oscillate vertically along their lengths while simultaneously changing the vertical orientation of the sides or surfaces of the enclosures 334. As described above, these movements can induce multidirectional (e.g., triaxial) movement of the media within the chambers 336 that provides for robust mixing of the media with the fluid and/or exposure of the media to the fluid.

The device 300 can be up-scaled to the size and weight that (i) a power and drive system can accommodate, and (ii) the plate 332, spindle 310, bearings, base, and/or stanchions can structurally support. In other embodiments, the device 300 can range in scale down to laboratory bench top applications where such a device size is suitable for device design and process optimization studies, engineered scaling evaluations, research, and low flow full-production or micro-production operations.

C. Selected Embodiments of Mixing Operations

The mixing devices of the present technology are well suited for mixing and contacting solid media with fluid using compound-complex material movements in numerous applications that may satisfy desired process requirements of polishing, burnishing, adsorption, catalyst efficiency, surficial reaction site cleaning, and/or scouring (e.g., where abrasion of solid media surfaces and moving solid mass will clean and help scour surface and interstitial accumulations), and/or other needs. Thus, the mixing devices of the present technology can be designed to accommodate and be operated to provide controlled delicate through robust mixing and intentional interactional contact of a solid media with a fluid.

In some embodiments, the mixing devices of the present technology can be used to mix solids and fluids to provoke or generate certain chemical reactions. For example, the chamber(s) can be filled with a pre-determined amount of zero-valent iron (ZVI) fines, filings, pieces, or other ZVI media, and acid mine drainage or another acidic fluid can be pumped into the chamber. The mixing of the ZVI media and the acidic fluid can result in various chemical reactions including acidity treatment and/or the oxidation or reduction of constituents in the fluid. Notably, the movement of the chamber causes multidirectional tumbling of the ZVI media which causes the acidic fluid to intimately contact the angular edges and other surfaces of the ZVI media creating de-scaling/anti-fouling media cleaning actions, thus maintaining active reaction sites on the ZVI media. In other embodiments, the media may be other materials such as ceramics, polishing abrasives, pellets, and/or other similar particles. The rotation speed of the chamber, fluid feed flow rate, media volume, temperature, pressure, retention time, device geometry, and other variables can be managed to generate a desired outcome.

In other embodiments, for example, a liquid can be mixed with a resin such as an ion-exchange solid granular media to prevent "rat-holing" effects, and to enhance uniform and intimate contact between the two materials. In yet other embodiments, a liquid can be mixed with a solid granular catalyst to ensure intimate contact for reaction purposes, and for mixing to ensure uniformity between liquid and catalyst, and to ensure catalyst-to-catalyst surfaces are not allowed to create non-reactive dead spots.

In some embodiments, the mixing devices of the present technology can be used to mix heterogenous materials (e.g., a liquid/supercritical fluid and a granular solid, a gas and a granular solid, a non-viscous and a more viscous liquid, etc.). For example, granular nutrients, fertilizers, bacteria, etc., can be mixed with water for commercial products prior to point-of-use packaging. In some embodiments, adsorbent media can be mixed with a liquid to ensure uniform dispersion of fluid in and around the adsorbent media for uniformity in media qualities and properties as a desired end-product. In some embodiments, mixing can cause dispersion of a gas or supercritical fluid into a liquid and/or deagglomeration and distribution of a solid friable or clumped granular material into a liquid. In other embodiments, mixing can be used to make-down a polymer solution from a dry or liquid polymer and another fluid or solvent such as water where high shear mixing is not required. In yet other embodiments, a partially soluble solid can be mixed into a fluid until a desired saturation point is achieved.

In another embodiment, a mixture of fluids, a fluid and a solid or solids, flowable solids, or other such media and mixtures may be combined and pre-blended in a tank or other device prior to being disposed in the chamber of a mixing device configured in accordance with the present technology. As one example, a non-liquid fluid (e.g., a supercritical gas such as carbon dioxide or nitrogen) can be pre-mixed and pumped into a chamber containing a solid (e.g., nanoparticles) for mixing. As another example, a liquid containing high levels of non-settleable solids can be pre-mixed with a polymer, a coagulant, and/or a flocculent, and the mixing device can provide suitable non-turbulent mixing to facilitate the nucleation of floc and settleable solid formation for post-device solids settlings and fluid clarification.

In some embodiments, the mixing devices of the present technology can be used to mix solids and fluids to equalize or control temperature. For example, different fluids having different temperatures can be combined prior to feed into a mixing chamber and, after mixing, the blended fluid end-product can be homogenous in consistency/uniformity and with a highly controlled/close tolerance final temperature. In some embodiments, a housing around the mixing device can be used to alter end-product temperature of the blended fluid to one that is higher or lower than what the thermodynamics of each fluid would naturally produce. In other embodiments, an acid can be mixed with a base to obtain a blended fluid at a desired temperature.

In some embodiments, the mixing devices of the present technology can provide mixing, blending, and/or reacting while also providing centripetal, centrifugal, gyroscopic, and/or other services in low gravity (e.g., space) where a plurality of balanced uniformly rotating assemblies uniformly revolve around a common centerline such that the entire collection of moving devices create a sufficient unidirectional outward force on media and fluid to replicate gravity and differential from the forces created by the rotating assemblies. In other embodiments, the mixing devices of the present technology can provide mixing, blending, and/or reaction with device located within a high pressure exterior environment (e.g., underwater).

D. Conclusion

The above detailed description of embodiments of the technology are not intended to be exhaustive or to limit the technology to the precise form disclosed above. Although specific embodiments of, and examples for, the technology are described above for illustrative purposes, various equivalent modifications are possible within the scope of the technology as those skilled in the relevant art will recognize. For example, although steps are presented in a given order, alternative embodiments may perform steps in a different order. The various embodiments described herein may also be combined to provide further embodiments.

From the foregoing, it will be appreciated that specific embodiments of the technology have been described herein for purposes of illustration, but well-known structures and functions have not been shown or described in detail to avoid unnecessarily obscuring the description of the embodiments of the technology. Where the context permits, singular or plural terms may also include the plural or singular term, respectively.

Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the technology. Further, while advantages associated with some embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

We claim:

1. A mixing device, comprising:

a spindle configured to rotate about a longitudinal axis; and a chamber assembly including— a plate coupled to the spindle; and an enclosure coupled to an outer peripheral portion of the plate and radially outward of the spindle, wherein the enclosure defines a chamber configured to receive a media, wherein the enclosure includes at least one sidewall that is obliquely angled relative to the plate, and wherein rotation of the spindle drives the plate to rotate and the enclosure to revolve about the longitudinal axis to move the media within the chamber, wherein the spindle extends at least between end portions of the chamber assembly.

2. The mixing device of claim 1 wherein the chamber is fluidly coupled to a fluid source.

3. The mixing device of claim 2 wherein—the enclosure includes a first end portion coupled to the plate and a second end portion opposite the first end portion, and wherein, during rotation of the plate, the fluid source is configured to pump a fluid through the chamber from the first end portion to the second end portion.

4. The mixing device of claim 2 wherein the spindle includes a bore fluidly coupled to the fluid source, and wherein the chamber is fluidly coupled to the bore.

5. The mixing device of claim 4, further comprising a swivel coupled to the spindle, wherein the swivel fluidly couples the bore to the fluid source.

6. The mixing device of claim 1 wherein the enclosure has a polygonal cross-sectional shape.

7. The mixing device of claim 1 wherein the enclosure has a rectangular cross-sectional shape.

8. The mixing device of claim 1 wherein the plate is a first plate, and further comprising a second plate coupled to the spindle, wherein the enclosure extends between and is coupled to the first and second plates, and wherein the at least one sidewall is obliquely angled relative to the second plate.

9. The mixing device of claim 1 wherein the enclosure does not include any mixing paddles extending into the chamber.

10. The mixing device of claim 1 wherein the enclosure is configured to receive a continuous supply of fluid from a fluid source, and wherein the plate includes a first side at which the enclosure is coupled and a second side opposite the first side, the mixing device further comprising tubing configured to receive the fluid and extending over the second side of the plate and to the enclosure at the outer peripheral portion of the plate.

11. The mixing device of claim 10 wherein the spindle is fluidly coupled to the fluid source, and wherein the tubing directs the fluid from the spindle to the enclosure.

12. A mixing device, comprising:

a chamber assembly including a plate configured to rotate about a longitudinal axis, and a plurality of enclosures each coupled to an outer peripheral portion of the plate and radially outward of the longitudinal axis, wherein— individual ones of the enclosures include (a) at least one sidewall that defines an oblique angle with the plate and (b) a chamber configured to receive a media and a fluid, the enclosures are configured to receive a continuous supply of fluid from a fluid source, and rotation of the plate revolves the enclosures about the longitudinal axis to mix the media with the fluid in the chambers; and a spindle coupled to the chamber assembly and extending at least between end portions of the chamber assembly along the longitudinal axis.

13. The mixing device of claim 12 wherein the enclosures are equally spaced radially and axially about the longitudinal axis.

14. The mixing device of claim 12 wherein the plate is a first rotatable plate, and further comprising a second rotatable plate, wherein— the enclosures extend between and are coupled to the first and second plates, the enclosures are arranged in pairs, and the enclosures of each pair cross radially by one another relative to the longitudinal axis.

15. The mixing device of claim 12, wherein the plate is a first plate disposed at one of the end portions of the chamber assembly, the mixing device further comprising a second plate disposed at another one of the end portions of the chamber assembly, wherein the spindle is coupled to the first and second plates, and wherein— the spindle is drivable to rotate the first and second plates, the spindle includes a bore extending at least partially therethrough, and the enclosures are fluidly coupled to the fluid source via the bore.

16. The mixing device of claim 12 wherein the oblique angle defined by the at least one sidewall of each enclosure is the same.

17. The mixing device of claim 12 wherein the oblique angle is between about 20°-30° .

18. A method of mixing a media with a fluid, the method comprising:

disposing the media within a chamber of an enclosure of a chamber assembly, wherein the enclosure is coupled to an outer peripheral portion of a plate at an oblique angle and radially outward of a spindle coupled to the plate, the spindle extending at least between end portions of the chamber assembly;

supplying the fluid to the chamber; and driving the spindle to thereby rotate the plate and revolve the enclosure about a longitudinal axis to mix the media with the fluid in the chamber.

19. The method of claim 18 wherein supplying the fluid to the chamber includes supplying the fluid while driving the spindle.

20. The method of claim 18 wherein supplying the fluid includes pumping the fluid (a) through a bore in the spindle, (b) from the bore through a tubing system to a first end portion of the chamber, and (c) from the first end portion of the chamber to a second end portion of the chamber, opposite the first end portion.

21. The method of claim 18 wherein driving the spindle revolves the enclosure to move the media (a) lengthwise through the chamber and (b) rotationally around a cross-sectional circumference of the chamber.

* * * * *